United States Patent [19]

Oishi

[11] Patent Number: 4,925,416

[45] Date of Patent: May 15, 1990

[54] CLUTCH FOR MARINE PROPULSION

[75] Inventor: Hiroshi Oishi, Hamamatsu, Japan

[73] Assignee: Sanshin Kogyo Kabushiki Kaisha, Hamamatsu, Japan

[21] Appl. No.: 414,727

[22] Filed: Sep. 29, 1989

Related U.S. Application Data

[63] Continuation of Ser. No. 205,199, Jun. 10, 1988, abandoned.

[30] Foreign Application Priority Data

Jun. 12, 1987 [JP] Japan ..... 62-146801
Jun. 18, 1987 [JP] Japan ..... 62-152208

[51] Int. Cl.[5] ..... B63H 23/04

[52] U.S. Cl. ..... 440/84; 440/86; 440/87; 74/480 B

[58] Field of Search ..... 440/1, 75, 84, 86, 87; 91/418, 427, 428; 123/336; 180/315, 320, 321, 335, 336; 74/DIG. 8, 480 B

[56] References Cited

U.S. PATENT DOCUMENTS

| | | | |
|---|---|---|---|
| 2,615,418 | 10/1952 | Aspenleiter | 440/87 |
| 2,618,235 | 11/1952 | Clark | 440/87 |
| 2,618,985 | 11/1952 | Morey | 440/87 |
| 2,624,212 | 1/1953 | Urquhart | 440/87 |
| 2,702,615 | 2/1955 | Morse | 440/86 |
| 2,703,989 | 3/1955 | Schroeder | 440/86 |
| 3,955,438 | 5/1976 | Zayrzewski | 440/87 |
| 4,412,826 | 11/1983 | Jones | 440/86 |
| 4,718,869 | 1/1988 | Fisher | 440/87 |

*Primary Examiner*—Joseph F. Peters, Jr.
*Assistant Examiner*—Clifford T. Bartz
*Attorney, Agent, or Firm*—Ernest A. Beutler

[57] ABSTRACT

A number of embodiments of marine outboard drives having throttle and transmission controls which are operated either at the outboard drive or remotely from it. At least one of the sets of controls is selectively disconnectable so that the other of the controls can operate the throttle and transmission without movement of the disconnected controls.

28 Claims, 12 Drawing Sheets

*Figure 15*
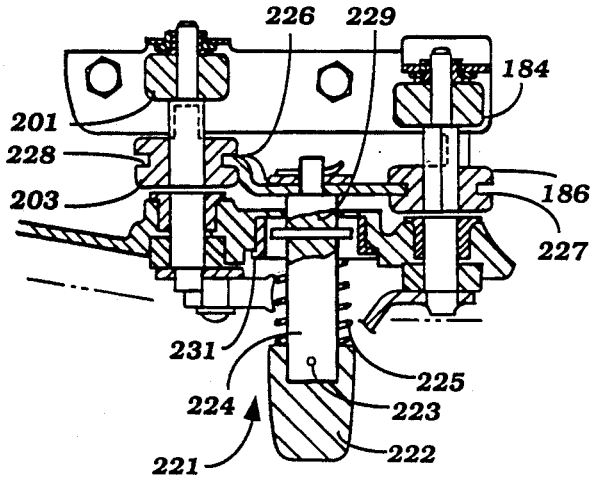
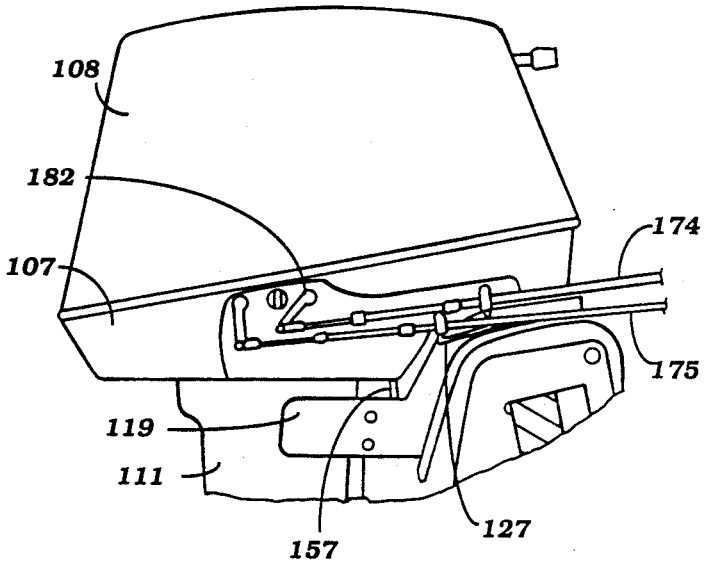
*Figure 16*

CLUTCH FOR MARINE PROPULSION

This is a continuation of U.S. patent application Ser. No. 205,199, filed Jun. 10, 1988 now abandoned.

BACKGROUND OF THE INVENTION

This invention relates to a clutch for a marine propulsion and more particularly to an improved control arrangement for a marine propulsion units.

In many forms of marine propulsion units, the outboard drive has a controlled element, such as a transmission or a throttle which is operated by means of a control device positioned at or adjacent to the outboard drive. In addition, it is common to provide a remote control device for the controlled element of the outboard drive which remote location is positioned in proximity to the operator's seat. At least the remotely positioned control device is connected to the controlled element normally by means of a bowden wire actuator. Although such arrangements are satisfactory, it is necessary for each of the control devices to be moved regardless of which one is employed for operating the controlled element. As a result, there are high loadings in the system, particularly when the controlled element is operated by the adjacent control device.

Even when the remote control device is not employed, it is frequently the practice to store it and the connecting mechanism within the outboard drive. As a result, the aforenoted disadvantages still prevail. Furthermore, when there are two separate control device each of which controls the controlled element, there is always the possibility of inadvertent or accidental control.

It is, therefore, a principal object of this invention to provide an improved control device for a marine propulsion unit.

It is a further object of this invention to provide a control arrangement for a marine propulsion having separate control devices wherein either of the control devices may be used selectively to operate the propulsion means.

It is a further object of this invention to provide an improved, simplified remote control arrangement for a marine propulsion wherein the remote control device can be disconnected from the marine propulsion if desired.

In the case of outboard motors, the motor may have, in addition to a transmission shift control, also a throttle control. It is frequently the practice to provide both adjacent and remote controls for both of these systems. In connection with the remote control, frequently a single lever control is employed that operates both the transmission and throttle in a staged sequence. However, even such single lever controls have the aforenoted disadvantages. Furthermore, when two separate controls are employed, the system becomes more complicated and the problems aforenoted can be compounded.

It is, therefore, a still further object of this invention to provide an improved and simplified control arrangement for remotely controlling an outboard motor.

It is a yet further object of this invention to provide a simplified control mechanism for an outboard motor wherein the remote throttle and transmission devices may be disconnected and this disconnection may be done simultaneously.

In connection with the use of a disconnectable connection for the remote operators of a marine propulsion unit, it is desirable to provide the disconnectable connection at a position that is close in proximity to the outboard drive. By doing so, the unnecessary loadings of the remote control devices can be substantially reduced when the remote control devices are not employed.

It is, therefore, a still further object of this invention to provide an improved and simplified device for disconnection a remote control device from a marine propulsion unit.

Due to the environment in which marine propulsion units are employed, it is desirable to position any disconnectable connection in the operating mechanism in such a way that it cannot become corroded. It is, therefore, a still further object of this invention to provide an improved arrangement for protecting a disconnectable connection in a remote operator for a marine propulsion unit.

SUMMARY OF THE INVENTION

This invention is adapted to be embodied in a marine outboard drive that is adapted to be affixed to the transom of a watercraft for propelling the watercraft. A controlled element is carried by the outboard drive and is moveable into selected positions for changing the state of operation of the outboard drive. First control means are juxtaposed to the outboard drive and means operatively connect the first control means to the controlled element for moving the controlled element between its selected positions. Second control means are positioned at a different location relative to the outboard drive from the first control means and means operatively connect the second control means to the controlled element for moving the controlled element between its selected positions. At least one of the operative connections between one of the control means and the controlled element includes disconnectable means for permitting the other of the control means to operate the control device without movement of the one control means.

BRIEF DESCRIPTION OF THE DRAWINGS

FIG. 15 is a partial cross-sectional view, in part similar to FIG. 12, showing the remote control devices in their disconnected positions.

FIG. 16 is a partial side elevational view of the powerhead of the outboard motor of this embodiment.

DETAILED DESCRIPTION OF THE PREFERRED EMBODIMENTS

Embodiment Of FIGS. 1 Through 8

Figure 1:
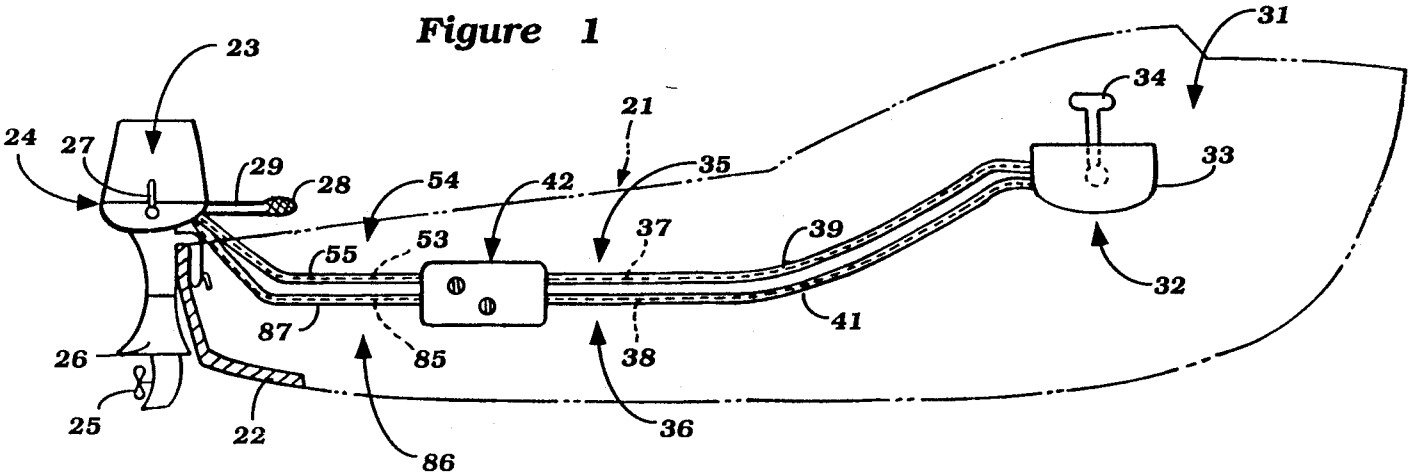
FIG. 1 is a side elevational view of a watercraft constructed in accordance with a first embodiment of the invention, with portions broken away and other portions shown in phantom.
Figure 2:
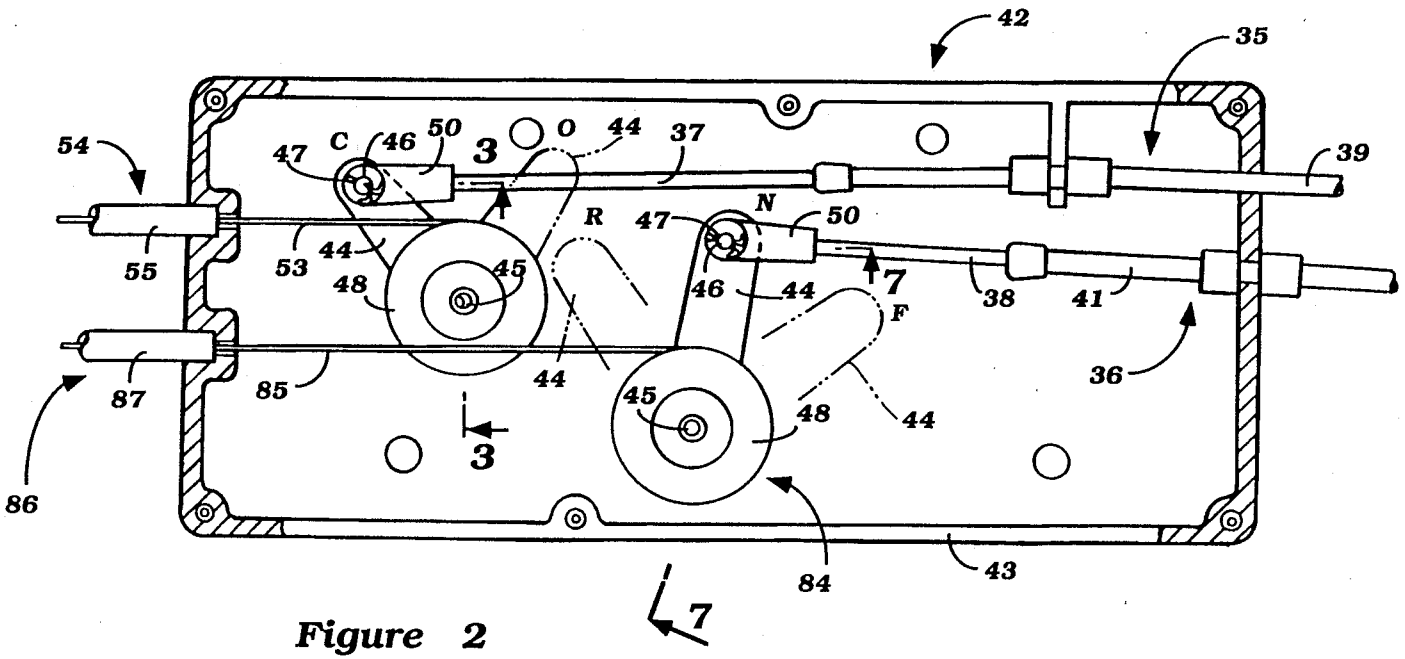
FIG. 2 is an enlarged cross-sectional view showing the disconnectable connection between the remote control operator and the controlled devices.

Referring first to FIG. 1, a watercraft constructed in accordance with this embodiment is identified generally by the reference numeral 21. The watercraft 21 is comprised of a hull 22 having an outboard motor 23 mounted on its transom in a known fashion. The outboard motor 23 includes a powerhead 24, which is shown in more detail in FIG. 8 and which will be described later, that contains an internal combustion engine for driving a propeller 25 of a lower unit 26 in known manner. The lower unit 26 includes a forward neutral reverse transmission, of a known type, and which is shifted by means of a shift lever 27 carried by the powerhead 24. The speed of the engine of the powerhead 24 is controlled by means of a twist type throttle 28 carried on the tiller 29. These controls mounted on the outboard motor 23 (shift lever 27 and throttle 28) are of conventional types.

In order to permit operation of the watercraft 21 from a remote location such as an operator's area, indicated generally by the reference numeral 31, there is provided a remote control mechanism 32. The remote control mechanism 32 may be of any conventional single lever type and includes a base or mounting portion 33 that is affixed to the hull 22 in an appropriate manner. A control lever 34 is supported by the base 33 and is operative upon initial movement in either a forward or reverse direction to shift the transmission of the lower unit 26 from neutral (N) into either forward (F) or reverse (R). Upon continued movement of the control lever 34 in either direction, the speed of the outboard motor 23 is increased. As is conventional, the throttle and transmission controls are achieved by means of respective bowden wire actuators 35 and 36. These bowden wire actuators 35 and 36 each include a respective wire actuator 37 and 38 and a surrounding protective sheath 39 and 41.

In a conventional arrangement, the wire actuators 35 and 36 would be connected to the transmission and throttle controls of the outboard motor 23 so that the control lever 34 or outboard motor mounted controls 28 and 27 could be utilized to operate either the throttle or clutch, respectively. However, such conventional arrangements would mean that an operator twisting the throttle lever 28 would also have to actuate the bowden wire 35 and lever 34. In a like manner, shifting of the transmission by the transmission control 27 would be accompanied by movement of the wire actuator 36 and single lever control 34. However, in accordance with the invention there is provided a disconnecting mechanism a clutch, indicated generally by the reference numeral 42 in each connection between the wire actuators 35 and 36 and the transmission and throttle controls of the outboard motor 23. The selectively operable disconnecting mechanism 42 is shown in most detail in FIGS. 2 through 7 and includes an outer housing 43 in which a throttle controlling lever 44 is supported on a fixed shaft 45. The bowden wire 37 is connected to one end of the lever 44 by means of a clevis 50 and pivot pin 46. The clevis 50 is held in place by means of a cotter key 47. Reciprocation of the wire actuator 37 will move the lever 44 from an idle position (C) as shown in solid lines in FIG. 2 and a full throttle position (O) as shown in the phantom line view of this Figure.

A throttle controlling drum 48 is rotatably journaled on the shaft 45 and is axially moveable relative to it. The drum 48 has a keyed recess 49 that is juxtaposed to a lug 51 formed on the lever 44. A coil compression spring 52 encircles the pin 45 and normally urges the drum 48 so that the lug 51 is spaced outwardly of the recess 49.

The drum 48 is connected to the wire 53 of a further bowden wire assembly, indicated generally by the reference numeral 54. The bowden wire assembly 54 is completed by a protective sheath 55 that extends between the housing 43 and the powerhead 24 of the outboard motor 23. As will be described in conjunction with FIG. 8, the wire actuator 53 is connected to the throttle controlling mechanism of the engine of the powerhead 24 in a conventional manner.

As has been described, the coil compression spring 52 normally holds the drum 48 in a disconnected or unclutched state from the lever 44. A mechanism is provided, however, for coupling or clutching the drum 48 for rotation with the lever 44 so that the single lever control mechanism 32 may control the throttle of the engine of the outboard motor 23.

This coupling mechanism includes a control knob 56 that is exposed through one side of the housing 43 and which has a hub portion that is slidably supported on the pin 45. The hub portion of the knob 56 passes through a key shaped opening 57 in the housing 43. A key or lug 58 is formed on the knob 56 for a reason to be described. The lug 58 normally extends through a key shaped portion 59 of the opening 57.

A threaded member 61 is threaded onto the inner portion of the knob 56 and engages an anti-friction collar 62 that is slidably supported upon the pin 45. The coil compression spring 52 maintains the drum 48 in engagement with the anti-friction collar 62 which is, in turn, urged into engagement with the collar 61.

Figure 4:
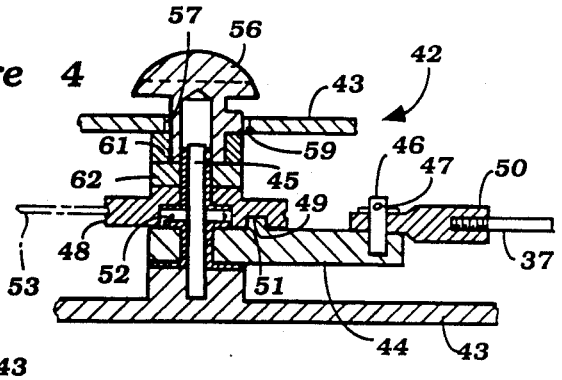
FIG. 4 is a cross-sectional view, in part similar to FIG. 3, showing the mechanism in its clutched or engaged position.
Figure 5:
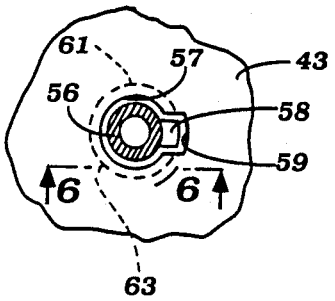
FIG. 5 is a cross-sectional view taken along the line 5—5 of FIG. 3.
Figure 6:
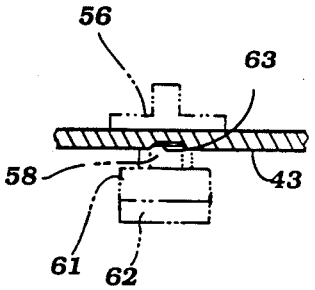
FIG. 6 is a cross-sectional view taken along the line 6—6 of FIG. 5.

In order to engage the control lever 34 with the throttle actuating wire 53, the knob 56 is urged inwardly against the action of the coil spring 52 to the postion shown in FIG. 4. When the knob 56 is thus moved inwardly, the lug 51 will be engaged in the recess 49 of the drum 48 so as to rotatably couple the drum 48 with the lever 44. The knob 56 is then rotated so that the lug or key 58 moves from the registry with the key shaped portion 59 of the key shaped opening 57 into a position where it engages a detent recess 63 (FIGS. 5 and 6) of the wall 43. The coil compression spring 52 will maintain the lug 58 in the recess 63 and thus prevent inadvertent disengagement of the coupling mechanism.

Figure 3:
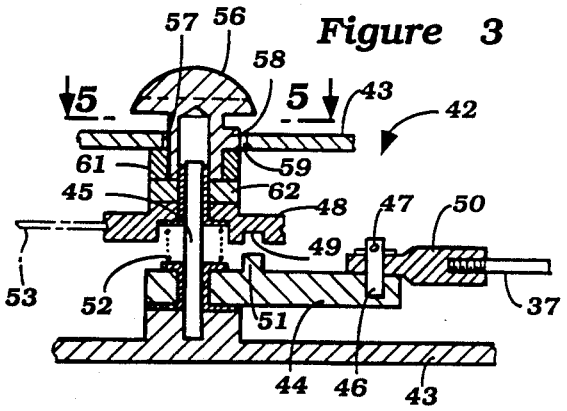
FIG. 3 is a cross-sectional view, on an enlarged scale, taken along the line 3—3 of FIG. 2 and shows the connection in a disconnected position.

When it is desired to disconnect the control of the engine speed by the single lever control 34, the knob 56 is again rotated so that it registers with the key shaped opening portion 59 and the coil spring 52 then urges the drum 48 to the disengaged position as shown in FIG. 3. Preferably, this is done when the engine is returned to its idle condition and the lever 34 is in its idle, neutral position.

Figure 8:
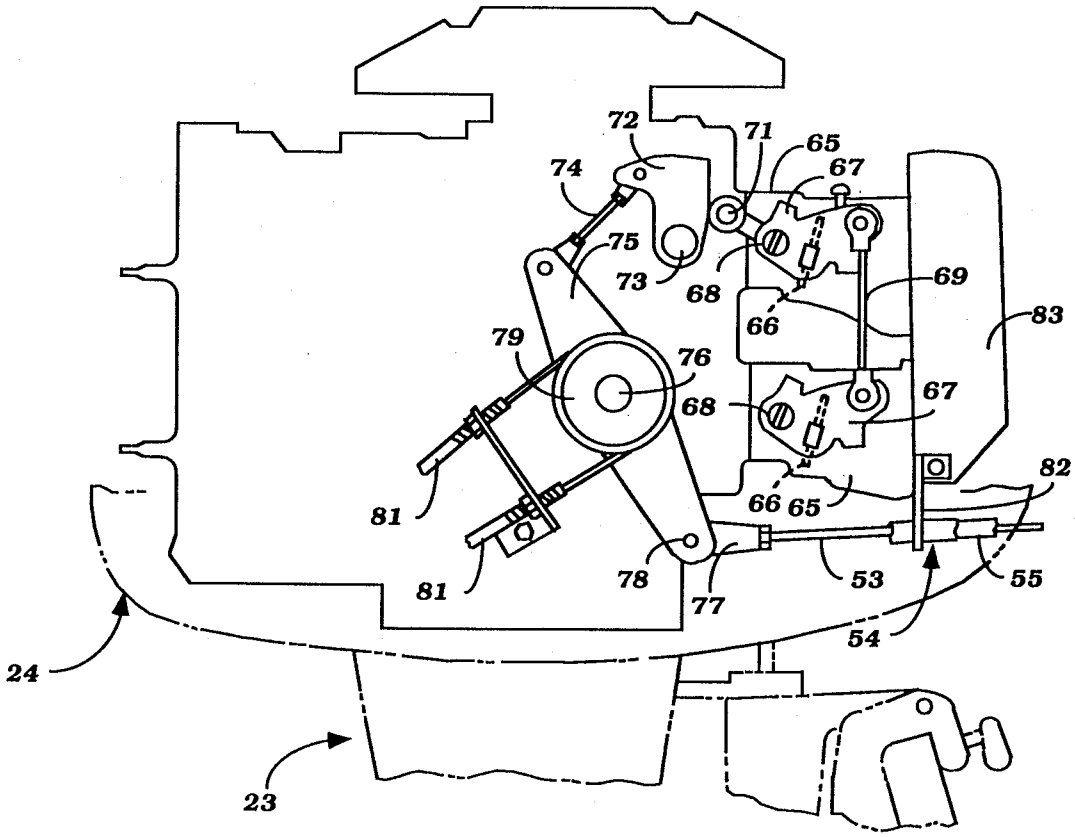
FIG. 8 is an enlarged side elevational view, with portions broken away, of the powerhead of the outboard motor of this embodiment.

The connection of the wire 53 to the throttle mechanism of the engine of the outboard motor 23 is shown in FIG. 8 and will now be described by reference to that Figure.

An internal combustion engine, which may be of any known type, is indicated generally by the reference numeral 64. The engine 64 is provided with a pair of carburetors 65, each of which has a speed controlling throttle valve 66 journaled in its induction passage. The throttle valves 66 are affixed for rotation with levers 67 by means including adjusting screws 68 so as to adjust the relative position of the lever 67 to the throttle valve 66. The levers 67 are connected to each other for simultaneous movement by means of a link 69.

One of the levers 67 carries a follower mechanism 71 that is engaged with a throttle controlling cam 72. The throttle controlling cam 72 is supported on the engine 64 for pivotal movement by means of a pivot pin 73.

The throttle controlling lever 72 is connected by means of a link 74 to a throttle control arm 75. The throttle control arm 75 is journaled on the engine 64 by means of a pivot pin 76. The throttle controlling wire 53 is connected by means of a clevis 77 and pivot pin 78 to another arm of the throttle arm 75 for rotating the arm and cam 72 to control the position of the throttle valve 66.

A throttle controlling drum 79 is also connected to the arm 75 and is operated by means of wire actuators 81 which are connected in a known manner to the twist throttle control 28. In this way, the position of the throttle valve 66 can be controlled by either the twist grip 28 or lever 34, as aforedescribed.

It should be noted that the protective sheath 55 of the bowden wire 54 is mounted by means of a bracket 82 that is affixed to the air inlet device 83 of the carburetors 65.

Figure 7:
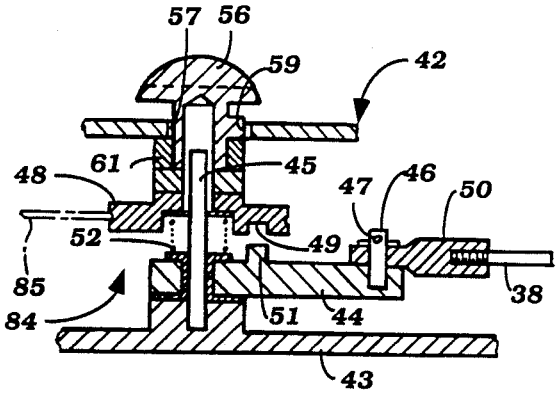
FIG. 7 is an enlarged cross-sectional view taken along the line 7—7 of FIG. 2.

A selectively operable coupling mechanism or clutch 84 is provided for selectively coupling the transmission controlling wire 38 with a corresponding wire 85 of a bowden wire mechanism 86 for movement between a neutral position (N) and forward (F) or reverse (R). The bowden wire mechanism 86 also includes a protective sheath 87. The wire 85 is connected to the transmission controlling mechanism in any known manner. The coupling mechanism 84 is identical in construction to the coupling mechanism of the throttle control and, for that reason, this construction has been identified by the same reference numerals and, will not be described again in detail. This construction is shown in FIG. 7 and the same reference numerals have been employed in this Figure as in FIGS. 3 through 6 to indicate components which are identical in construction and operation to the coupling mechanism of the throttle control.

Embodiment Of FIGS. 9 Through 16

In the embodiment of FIGS. 1 through 8, a separate control knob was required for operating the coupling of the remote throttle and shift controls and these couplings were positioned within the hull of the watercraft. Although such a construction has a number of advantages, in some instances it may be desirable to provide a single operator for simultaneously coupling and uncoupling both the remote throttle and transmission controls and also there may be some advantage in positioning the coupling mechanism within the powerhead of the outboard motor for protection from the elements. FIGS. 9 through 16 show such an embodiment.

Figure 9:
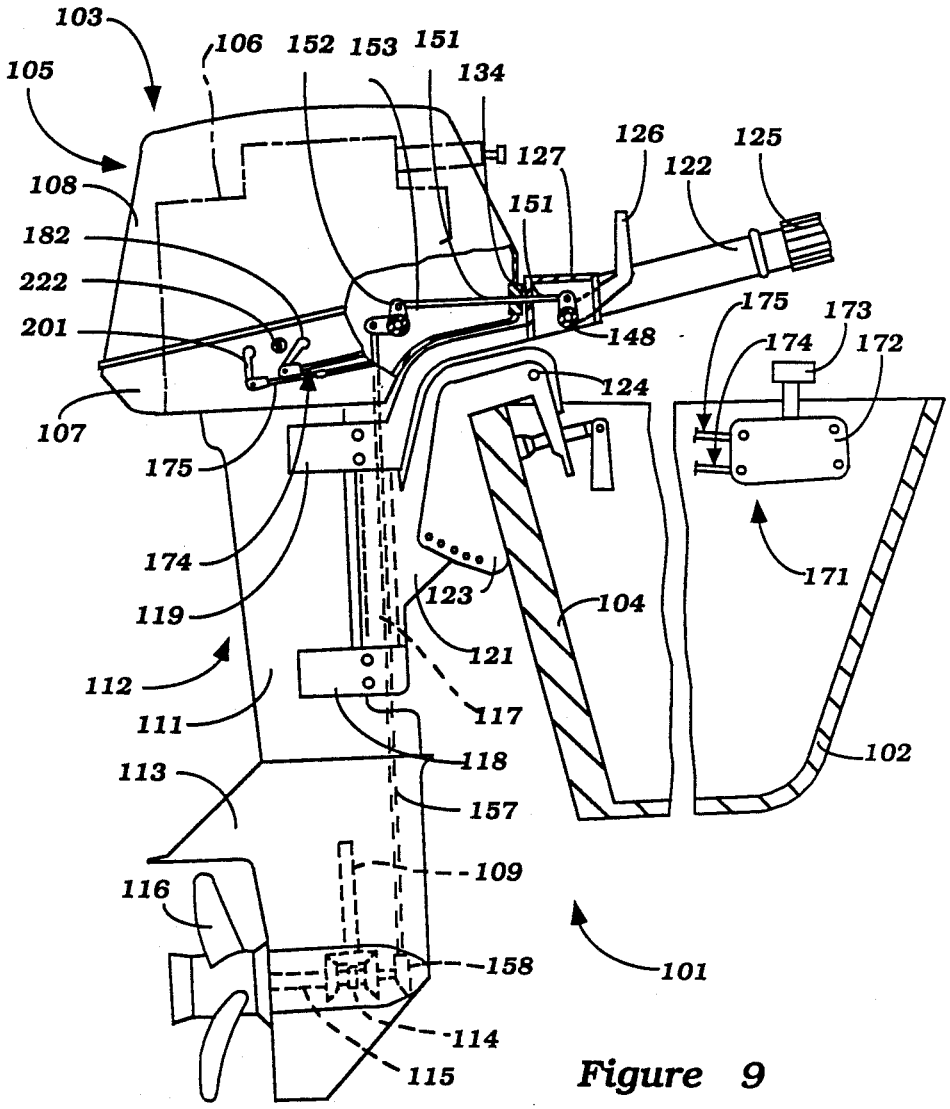
FIG. 9 is a side elevational view of a watercraft constructed in accordance with a second embodiment of the invention, with portions broken away and other portions shown in sections.
Figure 10:
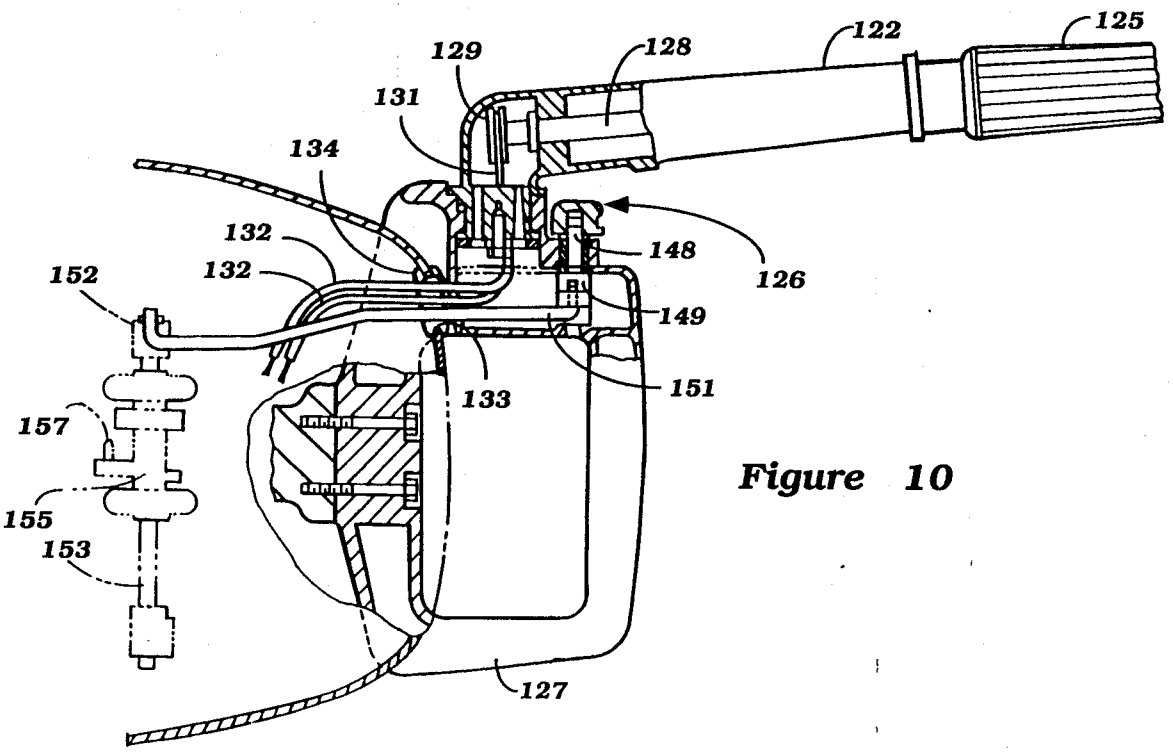
FIG. 10 is a top plan view, with a portion broken away, showing the construction of the controllers carried by the outboard motor of this embodiment.

Referring initially primarily to FIG. 9, a watercraft constructed in accordance with this embodiment of the invention is identified generally by the reference numeral 101. The watercraft 101, like the previously described embodiment, includes a hull 102 that is propelled by means of an outboard motor 103 that is connected to the transom 104 of the hull 102 in a manner to be described. The outboard motor 103 is comprised of a powerhead, indicated generally by the reference numeral 105 that consists of an internal combustion engine 106 of any known type and a protective cowling comprised of a lower tray 107 and main cowling portion 108 that are affixed to each other in any suitable manner.

The engine 106 has its output shaft drivingly coupled to a drive shaft 109 that depends through and is journaled within an outer housing 111 of a drive shaft housing assembly 112. The drive shaft 109 extends into a lower unit 113 wherein a conventional forward neutral reverse transmission 114 selectively couples the drive shaft 109 for rotation with a propeller shaft 115. A propeller 116 is affixed to the propeller shaft 115 for powering the watercraft 101 in a known manner.

A steering shaft 117 is affixed to the drive shaft housing 111 by means of a lower bracket 118 and an upper bracket 119. The steering shaft 117 is, in turn, journaled for steering movement about a generally vertically extending steering axis within a swivel bracket assembly 121. It should be noted that a tiller 122 is affixed to the bracket 119 for steering of the outboard motor 103 and watercraft 101.

The swivel bracket 121 is pivotably connected to a clamping bracket 123 by means of a pivot pin 124 so that the trim position of the outboard motor 103 may be adjusted relative to the transom 104. In addition, this construction permits tilting up of the outboard motor 103, as is well known in this art.

A twist type throttle control 125 is carried at the outer end of the tiller 122 for providing control of the speed of the engine 106 in proximity to the outboard motor 103. In a similar manner, a shift lever 126 is carried by a supporting bracket 127 in proximity to or upon the tiller 122 for controlling the transmission 114 in proximity to the outboard motor 103.

The twist throttle control 125 is affixed to a throttle control shaft 128 (FIG. 10) which is journaled within the tiller 122 in any appropriate manner. A drum 129 is affixed to the inner end of the throttle control shaft 128 and is, in turn, affixed to one end of a pair of wire control elements 131. The wire control elements 131 are portions of bowden wire actuators that further include protective sheaths 132. The protective sheaths 132 extend through an opening 133 in the protective cowling which is sealed by an elastomeric grommet 134.

The other ends of the control wire 131 are affixed to a throttle controlling lever or pulley 133 (FIG. 14) in the suitable manner. The throttle controlling lever 133 is pivotably supported on the engine 106 by means of a pivot shaft 134. The throttle controlling lever 133 has a cam surface 135 that is engaged with a roller follower 136 that is connected to a throttle control link 137 by means of an adjustable connection 138. The lever 137 is connected to a throttle valve (not shown) of a carburetor 139 in a known manner. The lever 137 is, in turn, connected by means of a link 141 to a throttle control lever 142 of a further carburetor 143 so that the throttle valves of the carburetors 139 and 143 will be operated in unison.

A spark control lever 144 is normally urged for rotation with the throttle control lever 133 by means of a torsional spring (not shown). The spark control lever 144 is connected by means of a link 145 to a spark advance plate 146 of a fly wheel magneto assembly 147 for advancing the spark timing as the throttles are opened. The spark advance continues up to a predetermined point at which the spark control lever 144 engages an adjustable stop (not shown) to limit the maximum spark advance. After this, the torsional spring will yield so that the throttle control lever 135 may continue to rotate to fully open the throttle valves of the carburetors 139 and 143.

Referring again to FIGS. 9 and 10, the transmission control lever 126 is affixed to a shaft 148 that is journaled upon the bracket 127. The shaft 148 has affixed to its inner end a lever arm 149 which is, in turn, pivotably connected to one end of a shift link 151. The shift link 151 extends also through the grommet 134 for sealing purposes and is pivotably connected at its other end to a further lever 152. The lever 152 is, in turn, affixed to a shaft 153 which is journaled within the lower tray 107 of the powerhead 105 in an appropriate manner. The shaft 153 may be inserted through an opening formed in the lower tray 107, which opening is closed by a closure plug 154 after assembly. A sleeve 155 is affixed to the shaft 153 and has a lug 156 to which one end of a shift link 157 is pivotably connected. The lower end of the shift link 157 is conncted to a shift cam 158 by means including a pin 159. The shift cam 158 is slidably supported within a recess formed in the lower unit 113 in general alignment with the propeller shaft 115.

Figure 11:
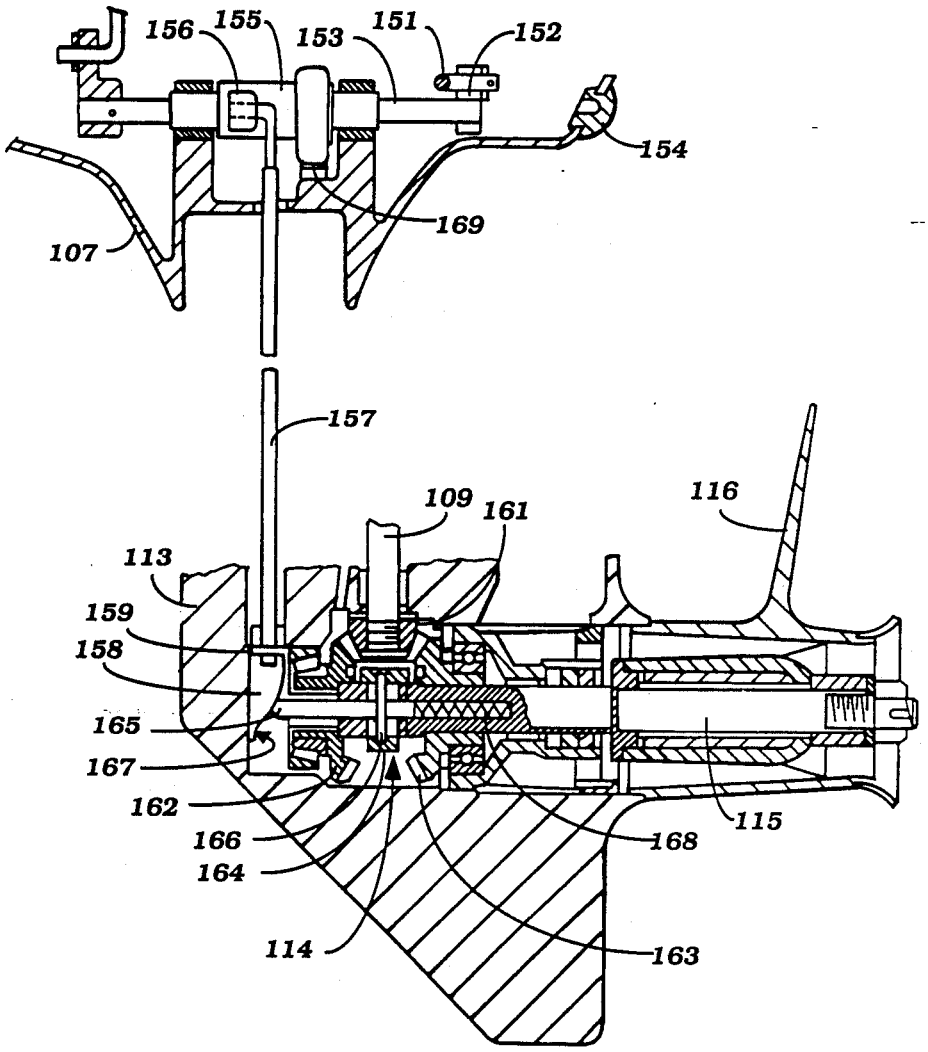
FIG. 11 is an enlarged cross-sectional view showing the operation of the transmission of this embodiment.

As may be best seen in FIG. 11, the forward neutral reverse transmission 114 is comprised of a bevel gear 161 that is affixed to the drive shaft 109 and which meshes with a pair of oppositely rotating bevel gears 162 and 163 that are journaled on the propeller shaft 115. A slidably supported dog clutching element 164 is disposed between the bevel gears 162 and 163 and is affixed to a plunger 165 by means of a pin 166. The plunger 165 is urged into engagement with a cam surface 167 on the shift cam 158 by means of a coil compression spring 168. The coil compression spring 168 is contained within the propeller shaft 115.

FIG. 11 shows the transmission in its neutral position. In this position, the dog clutching element 164, which is rotatably coupled to the propeller shaft 115 but axially slidable on it by means of a supplying connection will be out of engagement with respective dog clutching teeth formed on the bevel gears 162 and 163.

When the shift collar 155 is rotated so as to urge the shift rod 157 and shift cam 158 downwardly, the plunger 165 will be urged inwardly against the action of the coil compression spring 168 and the dog clutching element 164 will become engaged with the clutching teeth on the bevel gear 163 and the propeller will be driven in a reverse direction. When the shift sleeve 165 is rotated in the opposite direction so as to raise the shift rod 157 and shift cam 158, the coil compression spring 168 will urge the dog clutching element 164 forwardly to engage with the teeth on the bevel gear 162. At this time, the propeller 116 will be driven in a forward direction. A detent mechanism 169 is provided to act on the shift sleeve 155 so as to retain it and the shifting mechanism in the forward, neutral and reverse positions.

Referring again to FIG. 9, the watercraft 101 is also provided with a remotely positioned throttle and transmission controller, indicated generally by the reference numeral 171. As with the previously described embodiment, the controller 171 is spaced forwardly in the hull 102 from the outboard motor 103 in proximity to the operator's seat. The controller 171 includes a housing assembly 172 that pivotably supports a single control lever 173 of a known single lever type. The control lever 173 functions to operate a throttle controlling wire actuator assembly 174 and transmission controlling wire assembly 175. As with the previously described embodiment, movement of the control lever 173 from its neutral position as shown in FIG. 9 first causes shifting of the transmission, if the coupling mechanism to be described is engaged, and then advancing of the throttle position. As with the previously described embodiment, a coupling or clutch mechanism is provided for selectively coupling the wire actuators 174 and 175 with the throttle and transmission control mechanisms as thus far described.

This coupling mechanism may be best understood by reference to FIGS. 12 through 16 although certain components of it are shown in other Figures.

The throttle controlling wire actuator 174 is comprised of a wire element 176 that is operated at its forward end by the throttle control portion of the single lever control 171. A protective sheath 177 encircles the wire actuator 176 for the major portion of its length and is fixed to the lower tray 107 of the powerhead 105 by means of a bracket 178 having a first arm 179. The bracket 178 is held in place by means of mounting bolts 181.

Figures 12, 13:
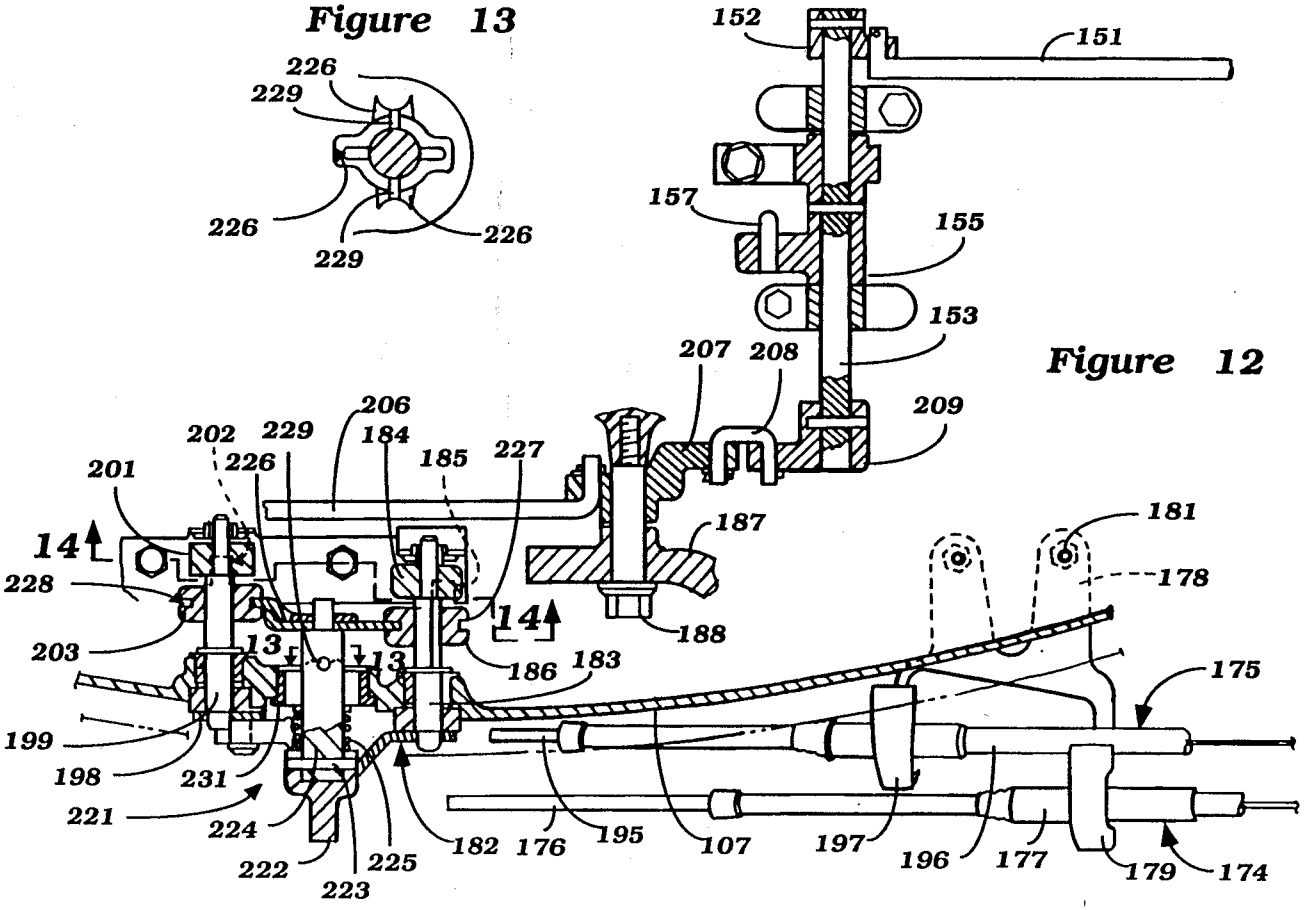
FIG. 12 is an enlarged top view, with portions broken away, showing the connection of the remote operators to the controlled elements and the disconnecting arrangement of this embodiment.
FIG. 13 is a cross-sectional view taken along the line 13—13 of FIG. 12.

The trailing end of the wire actuating element 176 is connected to a lever 182 which lever is in turn affixed for rotation with a shaft 183. The shaft 183 is suitably journaled within the lower tray 107. Journaled on the other end of the shaft 183 is a lever 184 which has a dog clutching recess 185. A dog clutching sleeve 186 has a square opening that is slidably supported upon a complementary shaped portion of the shaft 183 so as to rotatably couple the dog clutching element 186 with the shaft 183 while permitting axial movement therealong. FIG. 12 shows the dog clutching mechanism in its engaged position wherein the lever 184 will rotate simultaneously with the shaft 183. The mechanism for coupling and uncoupling the lever 184 with the shaft 183 will be described later.

Figure 14:
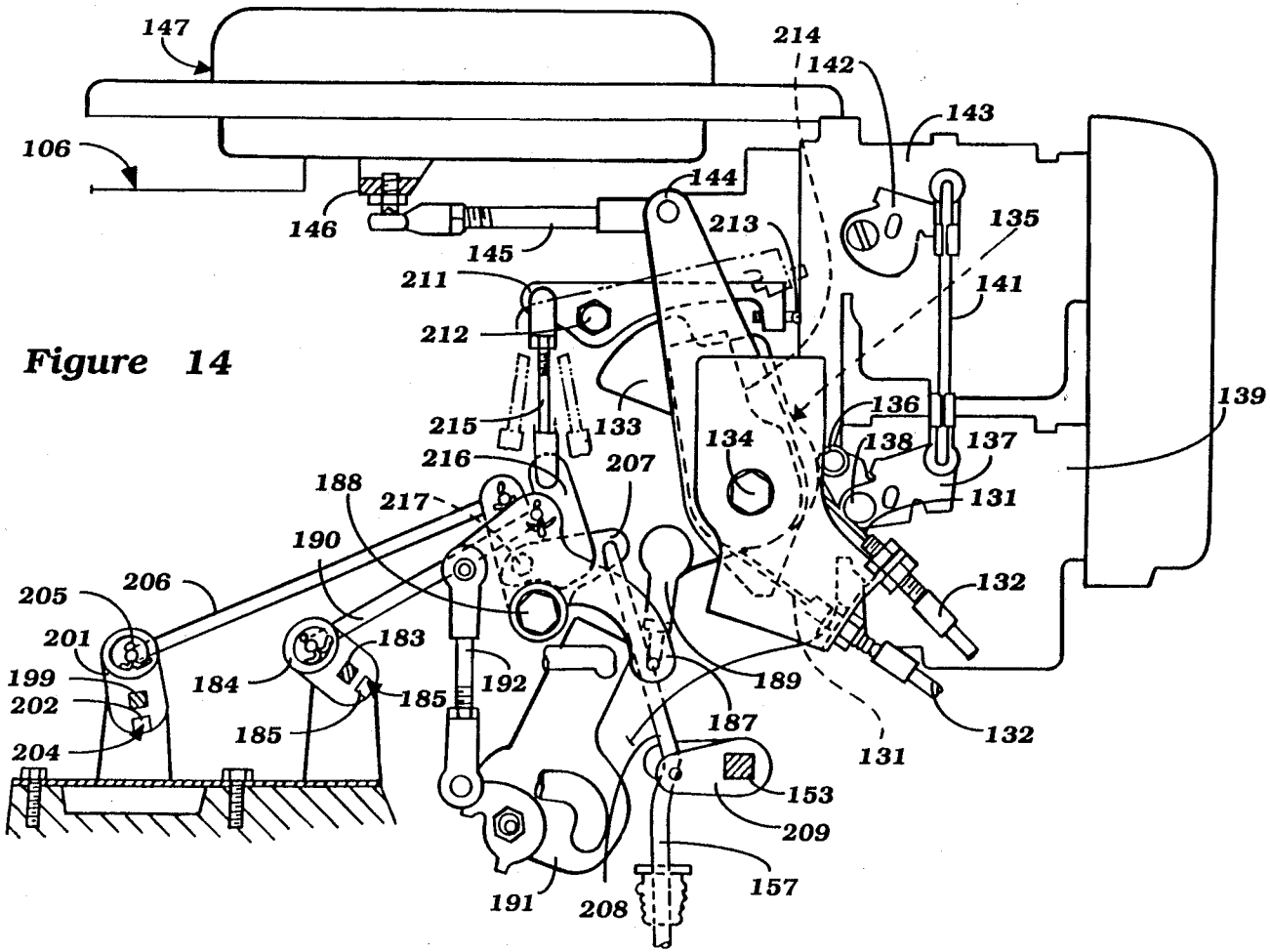
FIG. 14 is an enlarged cross-sectional view taken generally along the line 14—14 of FIG. 12.

Referring now to FIG. 14, the lever 184 is connected to one end of a link 190. The opposite end of the link 190 is pivotally connected to a throttle control lever 187 which is, in turn, journaled on the engine 106 by means of a pivot pin 188. The throttle control lever 187 is connected to the throttle controlling lever 134 by means of a short link 189.

When the coupling of the dog clutching element 186 is engaged with the lever 184, rotation of the shaft 183 will effect pivotal movement of the lever 187 and throttle controlling cam 135 so as to operate the throttle mechanism in the manner as aforedescribed.

The throttle lever 187, which rotates at all times when the throttle valves are operated is also connected to a lever 191 of a lubrication control pump by means of a link 192 so as to control the amount of lubricant delivered to the engine 106 in any known manner.

The transmission controlling wire actuator 175 is comprised of a wire element 195 that is surrounded by a protective sheath 196. The rear end of the sheath 196 is retained by an arm 197 of the bracket 178 (FIG. 12). The leading end of the wire element 195 is connected to the transmission control portion of the single lever control 171 in a known manner.

At its trailing end, the wire element 195 is pivotally connected to a lever 198 which lever is affixed for rotation with a shaft 199. The shaft 199 has journaled upon it a lever 201 which, like the lever 184 is provided with a dog clutching recess 202. A dog clutching element 203 is fixed for rotation but axially moveable relative to a squared portion of the shaft 199 and has a lug 204 that is adapted to enter into the recess 202 so as to rotatably couple the lever 201 for rotation with the shaft 199 and lever 198. The dog clutching element 203 is operated simultaneously with the dog clutching element 186, in a manner to be described.

The lever 201 is connected, by means including a cotter key 205, to one end of a link 206. The opposite end of the link 206 is connected to a shifting lever 207 which is also journaled on the pivot shaft 188. The shift lever 207 is connected by means of a link 208 to a lever 209 which lever is, in turn, affixed to the shift shaft 153 for operating the shift rod 157.

An interlock mechanism is provided that will insure against overspeeding of the engine when the transmission 114 is shifted into neutral and which also prevents shifting of the transmission until the engine speed has been reduced by closure of the throttle mechanism. This interlock mechanism includes a lever 211 which is pivotably supported on the engine 106 by means of a pivot pin 212. An adjustable stop 213 on the end of the lever 211 cooperates in a blocking position with a portion 214 of the throttle control lever 134 when the transmission has been shifted into neutral. A link 215 is pivotally connected to the lever 211 and to an extension 216 of the shift lever 206 that is coupled to the shift lever 207 by means of a pin 217 to achieve this result. When the transmission is in the neutral position, the lever 211 is in the blocking position as shown in the solid line views in FIG. 14. When the transmission is shifted into either forward or reverse, the lever 211 is pivoted to the phantom line position so as to permit unencumbered movement of the throttle.

The mechanism for operating the dog clutching elements 186 and 203 appears in most detail in FIGS. 12 and 13 and is indicated generally by the reference numeral 221. This mechanism includes a control knob 222 that is connected by means of a pin 223 to a shaft 224. A coil compression spring 225 encircles the shaft 224 and normally urges it and the knob 222 to an outer or extended position as shown in FIG. 15 wherein the lugs of the dog clutching elements 186 and 203 are out of engagement with the levers 184 and 201 so that the throttle and transmission may be controlled from the controls 125 and 126 without necessitating any movement of or encumbrance by the single lever control 171. It should be noted that there is a plate 226 that is carried at the inner end of the shaft 224 and which is received in grooves 227 and 228 of the dog clutching elements 184 and 203 so as to permit rotation of the dog clutching elements while coupling them for axial movement with the shaft 224.

The shaft 224 carries a cross pin 229 that is adapted to pass through a complementary shaped pair of openings in a bushing 231 carried by the lower tray 107 so as to hold the shaft 224 and knob 222 and dog clutching elements 186 and 203 in their engaged position when rotated and depressed to the position shown in FIG. 12. Release is achieved by rotating the shaft 224 and permitting the coil spring 225 to extend. There is further provided a detent mechanism 226 for locking the shaft 224 and knob 222 in the engaged position as shown in FIG. 12, as in the previously described embodiment.

Figure 17:
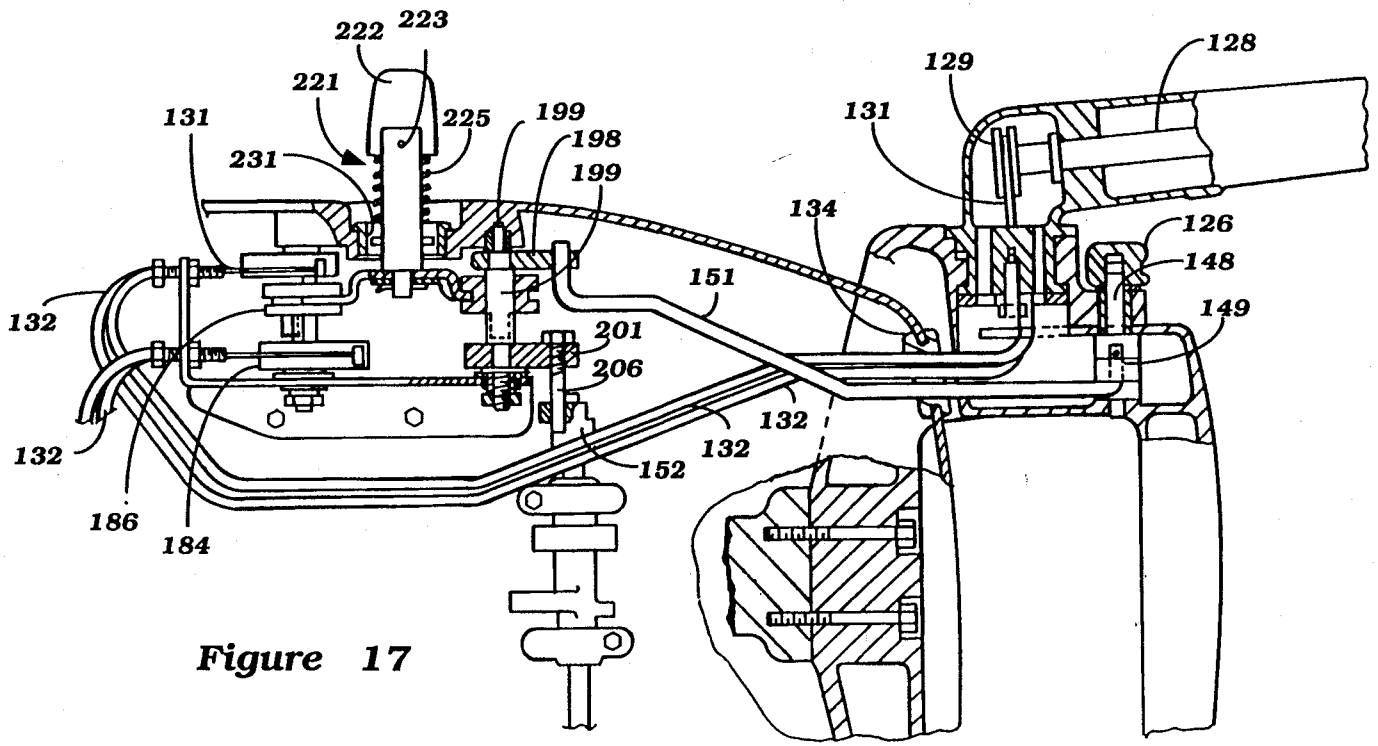
FIG. 17 is a view, in part similar to FIG. 12, showing another embodiment of the invention.

Embodiment Of FIG. 17

FIG. 17 shows another embodiment of the invention. This embodiment includes a coupling mechanism as in the embodiment of FIGS. 9 through 16. However, in this embodiment, the coupling mechanism couples the controls mounted on the outboard motor to the controlled elements of the outboard motor. In this embodiment, there are no remote controls, however, the controls of the outboard motor are disconnectably connected to the controlled elements of the transmission and throttle so as to permit disconnection for certain servicing operations. This disconnection may be accomplished without disconnecting the wire transmitters through the operation of the operation of the coupling mechanism which can be operated externally of the outboard motor without disassembly.

Because this embodiment is basically the same, except for the differences aforenoted, with the embodiment of FIGS. 9 through 16, corresponding elements have been identified by the same reference numerals and will not be described again in detail.

It should be understood that the coupling mechanism between the outboard motor controls and their controlled elements may also be used in connection with a remote control system either with or without a disconnectable coupling means between the remote controls and the control elements of the outboard motor.

SUMMARY

It should be readily apparent from the foregoing descriptions that a number of embodiments of the invention have been illustrated and described, each of which permits control of a marine outboard drive from either a proximate or remote location. The separate controllers need not move simultaneously due to the provision of a coupling device between at least one of them and the controlled element. Although a number of embodiments in the invention have been illustrated and described, various changes and modifications may be made without departing from the spirit and scope of the invention. For example, although all embodiments have been described in conjunction with outboard motors, certain facets of the invention may be utilized in conjunction with the outboard drive portion of an inboard/outboard drive unit. In connection with such an application, the transmission control only will have the remote operator that can be uncoupled since the engine control is positioned remotely from the outboard drive portion. Various other changes and modifications may also be made without departing from the spirit and scope of the invention as defined by the appended claims.

I claim:

1. A marine outboard drive adapted to be affixed to the transom of a watercraft for propelling the watercraft, a controlled element carried by said outboard drive and moveable into selected positions for changing the state of operation of said outboard drive, first manually operable control means juxtaposed to said outboard drive in a location to be directly operated by an operator, motion transmitting means operatively connecting said first control means to said controlled element for moving said controlled element between said selected positions in response to movement of said first control means, second manually operable control means positioned at a different location relative to said outboard drive from said first control means and in a position to be directly operable by an operator at said different location, and means operatively connecting said second control means to motion transmitting means for moving said controlled element between selected positions, in response to operation of said second control means, at least one of said operative connections between one of said control means and said controlled element including disconnectable means located between the point of connection of said second control means to said motion transmitting means and the respective control means for permitting the other of said control means to operate said control device without movement of the one control means and without necessitating removal of the one control means.

2. A marine outboard drive as set forth in claim 1 wherein the disconnectable means is selectively operable.

3. A marine outboard drive as set forth in claim 2 wherein the disconnectable means comprises a clutch.

4. A marine outboard drive as set forth in claim 1 wherein the controlled element comprises a throttle for controlling engine speed.

5. A marine outboard drive as set forth in claim 4 wherein the disconnectable means is selectively operable.

6. A marine outboard drive as set forth in claim 5 wherein the disconnectable means comprises a clutch.

7. A marine outboard drive as set forth in claim 1 wherein the controlled element comprises a transmission element in the power transmission of the outboard drive.

8. A marine outboard drive as set forth in claim 7 wherein the disconnectable means is selectively operable.

9. A marine outboard drive as set forth in claim 8 wherein the disconnectable means comprises a clutch.

10. A marine outboard drive adapted to be affixed to the transom of a watercraft for propelling the watercraft, a pair of controlled elements carried by said outboard drive and each moveable into selected positions for changing a respective state of operation of said outboard drive, a first pair of control means juxtaposed to said outboard drive, means operatively connecting each of said first pair of control means to a respective one of said controlled elements for moving said controlled elements between said selected positions, a pair of second control means positioned at a different location relative to said outboard drive from said first control pair of means, and means operatively connecting each of said second pair of control means to a respective one of said controlled elements for moving said controlled elements between selected positions, each of said operative connections including disconnectable means for permitting one of each of said first pair of said control means to operate the respective control device without movement of the corresponding one of the second pair of control means.

11. A marine outboard drive as set forth in claim 10 wherein each of the disconnectable means is selectively operable.

12. A marine outboard drive as set forth in claim 11 wherein the disconnectable means are simultaneously operable between their engaged and disengaged positions.

13. A marine outboard drive as set forth in claim 11 wherein the disconnectable means comprises clutches.

14. A marine outboard drive as set forth in claim 13 wherein the disconnectable means are simultaneously operable between their engaged and disengaged positions.

15. A marine outboard drive as set forth in claim 10 wherein each of the disconnectable means comprises a clutch.

16. A marine outboard drive as set forth in claim 15 wherein each of the disconnectable means is selectively operable.

17. A marine outboard drive as set forth in claim 16 wherein the disconnectable means are simultaneously operable between their engaged and disengaged positions.

18. A marine outboard drive as set forth in claim 10 wherein the outboard drive comprises an outboard motor and the first and second control means for operating each of the control elements are mounted on the outboard motor.

19. A marine outboard drive as set forth in claim 18 wherein the disconnectable means is contained within the outboard motor.

20. A marine outboard drive as set forth in claim 19 wherein the disconnectable means is contained within the powerhead of the outboard motor.

21. A marine outboard drive as set forth in claim 20 wherein each of the disconnectable means is selectively operable.

22. A marine outboard drive as set forth in claim 21 wherein the disconnectable means are simultaneously operable between their engaged and disengaged positions.

23. An outboard motor adapted to be affixed to the transom of a watercraft for propelling the watercraft, a controlled element carried by said outboard motor and moveable into selected positions for changing the state of operation of said outboard motor, first control means carried by said outboard motor, means operatively connecting said first control means to said controlled element within a protective cowling of said outboard motor for moving said controlled element between said selected positions, said operative connection between said first control means and said controlled element including disconnectable means operable from externally of said outboard motor protective cowling for disconnecting said control means from said control device.

24. A marine outboard drive as set forth in claim 23 wherein the controlled element comprises a throttle for controlling engine speed.

25. A marine outboard drive as set forth in claim 24 wherein the disconnectable means is selectively operable.

26. A marine outboard drive as set forth in claim 25 wherein the disconnectable means comprises a clutch.

27. A marine outboard device as set forth in claim 1 wherein the marine outboard drive includes a protective cowling and the connection of the second control means and the motion transmitting means is positioned within the protective cowling.

28. A marine outboard drive as set forth in claim 27 wherein the disconnectable means is positioned externally of the protective cowling.

* * * * *